United States Patent [19]

Pringle et al.

[11] 4,273,194

[45] Jun. 16, 1981

[54] ANNULAR FLOW CONTROL SAFETY VALVE

[75] Inventors: Ronald E. Pringle; Paul W. Black, both of Houston, Tex.

[73] Assignee: Camco, Incorporated, Houston, Tex.

[21] Appl. No.: 120,439

[22] Filed: Feb. 11, 1980

[51] Int. Cl.[3] ..... E21B 43/00

[52] U.S. Cl. ..... 166/323; 251/62

[58] Field of Search ..... 166/317, 321, 322, 323, 166/324, 72, 315; 251/62, 58

[56] References Cited

U.S. PATENT DOCUMENTS

| | | | |
|---|---|---|---|
| 3,850,250 | 11/1974 | Holden et al. | 166/315 |
| 3,930,540 | 1/1976 | Holden et al. | 166/315 |
| 3,970,147 | 7/1976 | Jessup et al. | 166/250 |
| 4,064,937 | 12/1977 | Barrington | 166/321 |
| 4,161,219 | 7/1979 | Pringle | 166/324 |
| 4,215,748 | 8/1980 | Pace et al. | 166/322 |
| 4,252,197 | 2/1981 | Pringle | 166/322 |

*Primary Examiner*—James A. Leppink

*Attorney, Agent, or Firm*—Fulbright & Jaworski

[57] ABSTRACT

A tubular housing having an inner tubular member forms an inner passageway inside of the inner member and an outer passageway between the inner member and the housing. The housing has valve openings leading from the outer passageway to the exterior of the housing and a tubular valve closure member telescopically moves on the interior of the housing. First means move the valve closure member in an upper direction for closing the openings and at least one actuating piston is telescopically movable within and has its longitudinal axis in the wall of the housing and engages the valve closure member. The piston is in communication with a hydraulic passageway adapted to extend to the well surface for actuating the closure member in a direction to open the valve openings. The closure member is positioned whereby upward flow through the outer passageway acts on the closure member to close the valve opening. At least one lockout piston telescopically moves within the housing and is actuated from the surface and is engageable with holding means in the housing for providing a hydraulic lockout for the valve. Shear means may be provided between the lockout piston and the housing for controlling the hydraulic lockout. A single seal is provided between the closure member and the housing and is positioned below the opening and exposed to the pressure on both sides when the valve is opened. Preferably the actuating pistons are connected to the valve closure member but the hydraulic lockout pistons engage but are unconnected to the valve closure member.

7 Claims, 5 Drawing Figures

ANNULAR FLOW CONTROL SAFETY VALVE

BACKGROUND OF THE INVENTION

While it is old to utilize a well safety valve for controlling the flow between the inside and outside of a valve, the present invention is directed to various improvements in a hydraulic control safety valve in which (1) the flow of well fluid acts on the valve to tend to close the valve, (2) the valve can be set at deeper depths with variable closing pressures by the use of dual actuating pistons, (3) a hydraulic permanent lockout piston is provided, (4) minimum sealing on the valve closure means is provided to minimize friction, and (5) the valve is short, light and has a minimum number of parts, and (6) wherein the actuating piston and lockout piston may be actuated independently or in combination.

SUMMARY

A well safety valve having a tubular housing and a tubular inner member forms an inner passageway inside of the inner member and an outer passageway between the inner member and the housing. The housing includes valve openings leading from the outer passageway to the exterior of the housing and a tubular valve closure member is telescopically movable on the interior of the housing for opening and closing the valve openings and is positioned whereby an upward flow through the outer passageway acts on the closure member to close the valve openings. Suitable means are provided for moving the valve closure member in an upward direction for closing, and at least one actuating piston is telescopically movable within and having its axis within the wall of the housing and engages the valve closure member and is connected to a hydraulic passageway adapted to extend to the well surface for actuating the closure member in a direction to open the valve openings.

A still further object of the present invention is the provision of at least one lockout piston telescopically movable within the wall of the housing which is adapted to engage the valve closure member and is in communication with a hydraulic passageway adapted to extend to the well surface for actuating the lockout piston for holding the valve in the open position. Means are provided between the lockout piston in the housing for holding the piston in the open position when actuated.

Still a further object of the present invention is the provision of shear means between the lockout piston and the housing for insuring that the lockout piston will not be inadvertently actuated.

Yet a still further object of the present invention is the provision of single sealing means between the closure member and the housing positioned below the openings and exposed to equal pressure on both sides when the valve is opened for minimizing friction of the seal on the tubular closure member.

A still further object of the present invention is the provision of the actuating pistons being connected to the valve closure member and the lockout pistons engaging but being unconnected to the valve closure member.

Yet a still further object is the provision of the actuating pistons and the lockout pistons being in communication with a common passageway extending to the well surface whereby the actuating piston and lockout pistons may be actuated together.

Other and further objects, features and advantages will be apparent from the following description of a presently preferred embodiment of the invention, given for the purpose of disclosure, and taken in conjunction with the accompanying drawings where like character references designate like parts throughout the several views.

DESCRIPTION OF THE PREFERRED EMBODIMENT

Figure 1A:
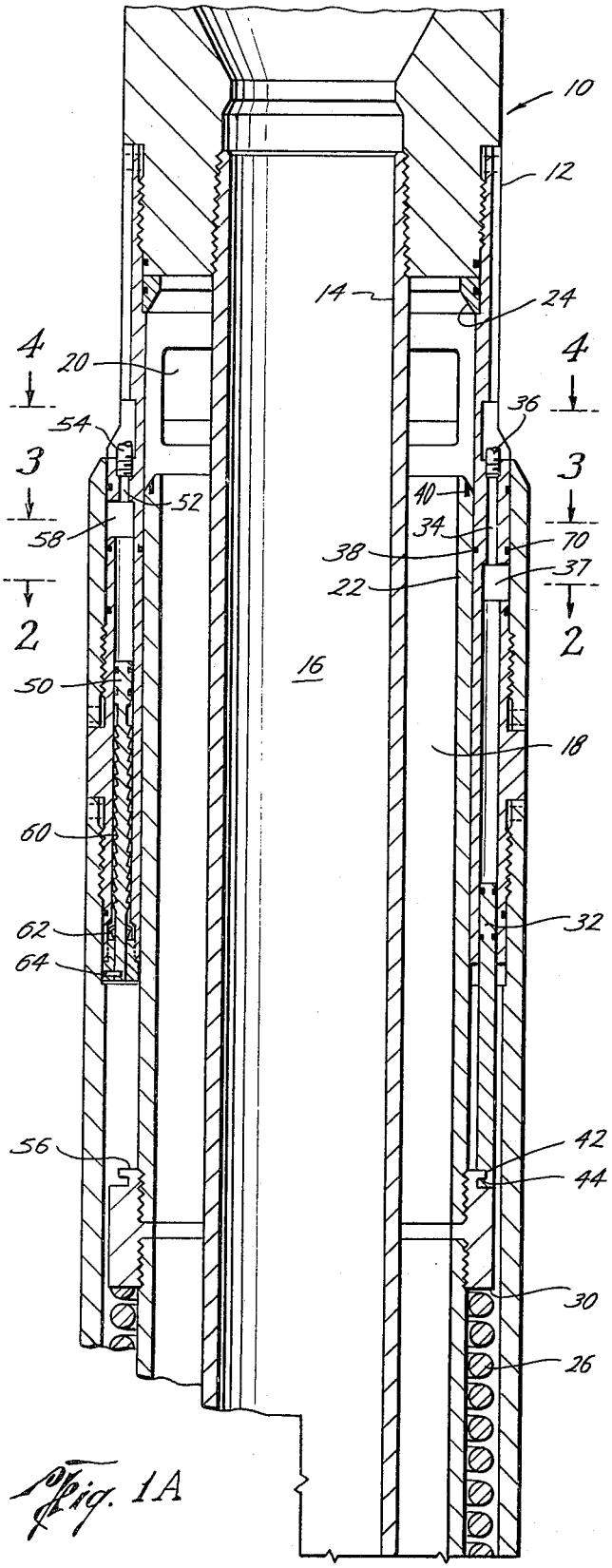
FIGS. 1A and 1B are continuations of each other and are fragmentary elevational views, in cross section along lines 1A and 1B of FIG. 2, of the apparatus of the present invention.
Figure 1B:
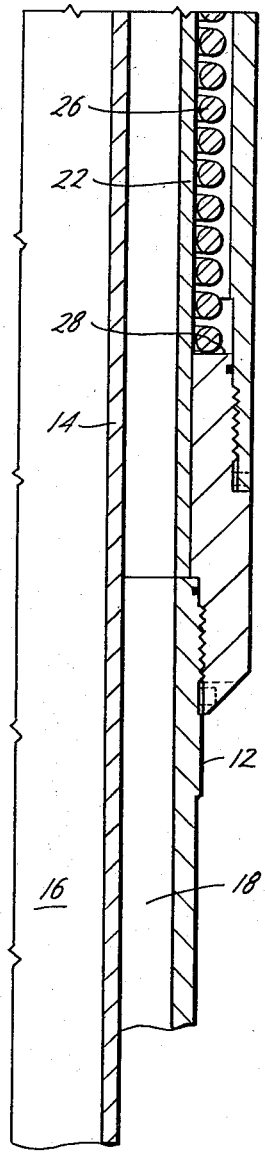
Figure 2:
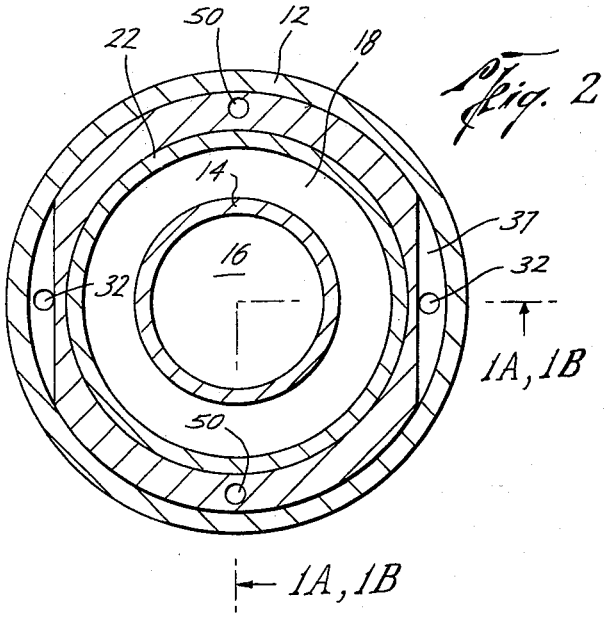
FIG. 2 is a cross-sectional view taken along the line 2—2 of FIG. 1A.
Figure 3:
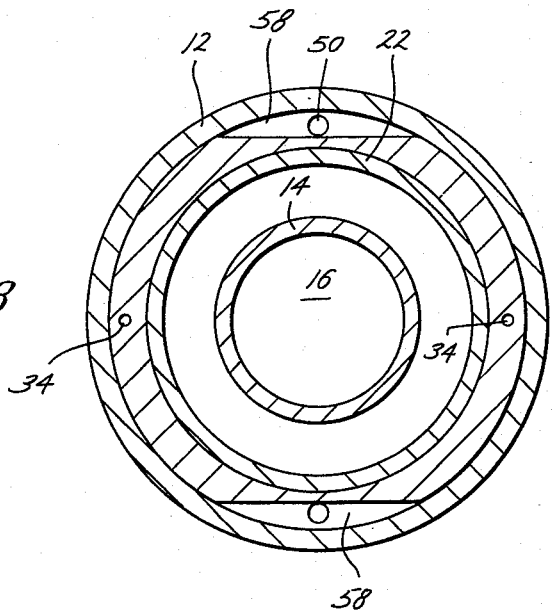
FIG. 3 is a cross-sectional view taken along the line 3—3 of FIG. 1A.

Referring now to the drawings, and particularly to FIGS. 1A and 1B, the annular flow control safety valve of the present invention is generally indicated by the reference numeral 10 and generally includes a tubular housing 12 and a tubular inner member 14. The housing 12 is normally used in the drilling string of an oil and/or gas well and the top of the housing generally includes a threaded connection (not shown) for connection in the tubing string and the bottom is adapted to be packed off by suitable well packers (not shown) in the well. Therefore, there is formed in the housing 12 an inner passageway 16 inside of the inner member 14 and an outer passageway 18 between the inner member 14 and the housing 12.

Figure 4:
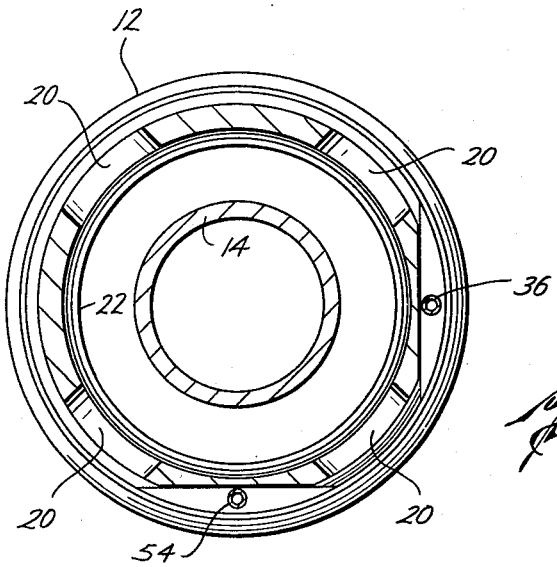
FIG. 4 is a cross-sectional view taken along the line 4—4 of FIG. 1A.

One or more valve openings 20 (FIG. 4) lead from the top of the outer passageway 18 to the exterior of the housing 12 for communicating the passageway 18 with the annulus between the housing 12 and a well casing (not shown). A tubular valve closure member 22 is telescopically movable on the interior of the housing 12 for opening and closing the valve openings 20. When the closure member 22 is in the down position as shown in FIGS. 1A and 1B, the valve openings 20 are opened and when the valve closure member 22 moves upwardly and seats on a valve seat 24, the openings 20 are closed.

The safety valve 10 is useful in various well applications such as injecting a fluid downwardly through the inner passageway 16 for increasing well recovery which flows upwardly through the outer passage 18 or the valve 10 may be used to produce well fluid upwardly through both passageways 16 and 18. In either case the volume of well fluid passing upwardly through outer passageway 18 may be considerable and it is to be noted that the closure member 20 is positioned in its open position whereby upward flow through the outer passageway 18 does not act to impede the closure of the valve closure member 22, but instead allows the passage of fluid through the outer passageway 18 to act on the closure member 22 in a direction to close the valve openings 20.

In order to control the movement of the valve closure member 22, various forces may be provided. Thus, biasing means, such as spring 26, may act between a shoulder 28 on the valve body 12 and the shoulder 30 connected to the valve closure member 22 for yieldably urging the valve closure member 22 in an upward direction to close the valve openings 20. In order to move the valve closure member 22 downwardly, and open the openings 20, one or more pistons 32, preferably two, are provided which are telescopically movable in the housing 12 and which have a cross-sectional area smaller than the thickness of the outer housing 12, as described in U.S. Pat. No. 4,161,219 and copending patent application Ser. No. 27,207, filed March 5, 1979, now U.S. Pat. No. 4,252,197, which are controlled by hydraulic fluid in a hydraulic passageway 34 which is adapted to extend to the well surface through a line 36 for actuating the closure member in a direction to open the valve openings 20. The use of the small cross-sectional area pistons 32 reduces hydrostatic forces acting through the passageways 34 for allowing the valve 10 to be used at greater depths in a well. The hydraulic passageway 34 is in communication with an annular passageway portion 37 for supplying the hydraulic actuating fluid to a plurality of pistons 32. Preferably the pistons 32 are connected to the closure member 22 by coacting shoulders 42 and 44 whereby pressure below the pistons 32 acts to move the piston 32 upwardly and assist in closing the valve.

Therefore, the safety valve 10 is controlled by the application or removal of a pressurized fluid through the control line 36 extending to the well surface which supplies a pressurized hydraulic fluid to the top of the pistons 32 which in turn acts on the tubular member 22 to move the valve closure member 22 downwardly opening the valve. If the fluid pressure in the conduit 36 is reduced sufficiently relative to the upward biasing force of the spring 26, the valve closure member 22 will be moved upwardly with the aid of fluid flowing upwardly through the outer passageway 18, to close the valve openings 20.

It is also to be noted that a single seal 38 may be provided between the housing 12 and the valve closure member 22 below the openings 20. The seal 38 is exposed to equal pressure on both sides of the seal 38 when the valve is opened thereby reducing the friction drag of the seal 38 on the closure member 22. A second seal 40 is provided on the end of the valve closure member 22 to seat on the valve seat 24.

The piston valve 10 is a tubing retrievable valve, that is the tubing must be removed from the well in order to retrieve the valve 10 and for such an application it may be desirable to provide a lockout for holding the valve in the open position in the event of the failure of the hydraulic actuating force. Therefore, one or more lockout pistons 50 such as two, are provided within the housing 12 at diametrically opposed locations in which the pistons 50 are in communication with a hydraulic passageway 52 which in turn is connected to a hydraulic line 54 adapted to extend to the well surface for actuating the pistons 50 in a downward direction. Downward movement of the pistons 50 will engage a shoulder 56 on the valve closure member 22 for moving the closure member 22 to an open position. The passageway 52 include an annular portion 58 for supplying hydraulic fluid to the pistons 50.

Preferably means are provided between the lockout piston 50 and the housing 12 for holding the piston 50 in the open position when actuated. Such holding rings may include co-acting rachet means 60 on the piston which co-act with rachet means 62 in the housing 12. It is to be noted that the lockout piston 50 is not connected to the closure member 22 but only engages the shoulder 56 when the piston 50 is actuated. In addition, shear means such as pin 64 may be provided between the piston 50 and the housing 12 for preventing actuation of the piston 50 until a predetermined hydraulic force is applied to the top of the piston 50 for actuating the hydraulic lockout.

While the actuating pistons 32 and the lockout pistons 50 may be operated downwardly separately from the control lines 36 and 54, respectively, the pistons 32 and 50 may be downwardly actuated by a single control line leading to the well surface such as by yoking the control lines 54 and 36 together or omitting the seal 70 between the annular passageway portion 37 and 58. In this event, the pistons 32 would be actuated downwardly by lower pressure, for example 1,000 pounds, while the lockout pistons 50 would be actuated until the shear pin 64 were sheared such as by 2,000 pounds of pressure.

The present invention, therefore, is well adapted to carry out the objects and obtain the ends and advantages mentioned as well as others inherent therein. While a presently preferred embodiment of the invention is given for the purpose of disclosure, numerous changes in the details of construction and arrangement of parts may be made which will readily suggest themselves to those skilled in the arts and which are encompassed within the spirit of the invention and the scope of the appended claims.

What is claimed is:

1. A well safety valve comprising, a tubular housing a tubular inner member connected to the housing and positioned concentrically in the housing forming an inner passageway inside of the inner member and an outer passageway between the inner member and the housing, said housing having valve openings leading from the outer passageway to the exterior of the housing, a tubular valve closure member telescopically movable on the interior of the housing for opening and closing said valve openings, said closure member positioned whereby upward flow through the outer passageway acts on the closure member to close said valve openings, means for moving the valve closure member in an upward direction for closing said openings, at least one actuating piston telescopically movable within and having its longitudinal axis within the wall of the housing and outside of the valve closure member, said piston engaging the valve closure member, the first side of the piston being in communication with a hydraulic passageway adapted to extend to the well surface for actuating said closure member in the direction to open said valve openings.

2. The apparatus of claim 1 including, at least one lockout piston telescopically movable within and having its longitudinal axis within the wall of the housing and outside of the valve closure member, said piston engaging the valve closure member, the first side of the piston being in communication with a hydraulic passageway adapted to extend to the well surface for actuating said closure member in the direction of open said valve openings, means between the lockout piston and said housing for holding the piston in the open position when actuated.

3. The apparatus of claim 2 wherein the holding means include rachet means between the piston and the housing.

4. The apparatus of claim 2 including, shear means between the lockout piston and the housing.

5. The apparatus of claim 1 including, single sealing means between the closure member and the housing positioned below the openings and exposed to equal pressure on both sides when the valve is open.

6. The apparatus of claim 2 wherein the one pistons are connected to the valve closure member and said other piston engage but are unconnected to the valve closure member.

7. The apparatus of claim 2 wherein the actuating pistons and the lockout pistons are in communication with a passageway adapted to extend to the well surface.

* * * * *